US008714539B2

(12) United States Patent
Kotaka

(10) Patent No.: US 8,714,539 B2
(45) Date of Patent: May 6, 2014

(54) RECORDING MEDIUM CASSETTE AND RECORDING APPARATUS

(71) Applicant: Seiko Epson Corporation, Tokyo (JP)

(72) Inventor: Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/967,211

(22) Filed: Aug. 14, 2013

(65) Prior Publication Data

US 2014/0054838 A1 Feb. 27, 2014

(30) Foreign Application Priority Data

Aug. 22, 2012 (JP) ..... 2012-182988

(51) Int. Cl.
*B65H 83/00* (2006.01)

(52) U.S. Cl.
USPC ..... 271/3.14; 271/9.08; 271/9.11

(58) Field of Classification Search
USPC ..... 271/9.01, 9.02, 9.07, 9.08, 9.11, 9.13, 271/3.14, 207
See application file for complete search history.

(56) References Cited

U.S. PATENT DOCUMENTS

2012/0080833 A1 4/2012 Asada et al.
2012/0081489 A1 4/2012 Asada et al.

FOREIGN PATENT DOCUMENTS

JP 2012-076871 4/2012
JP 2012-076872 4/2012
JP 2012-076873 4/2012

*Primary Examiner* — Michael McCullough
(74) *Attorney, Agent, or Firm* — Workman Nydegger

(57) ABSTRACT

A recording medium cassette includes a lower sheet placement unit on which a first recording medium is placed, an upper sheet placement unit on which a second recording medium is placed and configured to slide with respect to the lower sheet placement unit, and a recorded medium receiver on which the first recording medium and the second recording medium that have undergone a recording operation of a recording unit are placed. The recorded medium receiver is pivotably disposed at an end portion of the lower sheet placement unit in a feed direction. The upper sheet placement unit is pivotably disposed at the other end portion of the lower sheet placement unit in the feed direction.

5 Claims, 10 Drawing Sheets

RECORDING MEDIUM CASSETTE AND RECORDING APPARATUS

BACKGROUND

1. Technical Field

The present invention relates to a recording medium cassette and a recording apparatus.

2. Related Art

Existing recording apparatuses, such as printers and copiers, include those provided with a recording medium cassette that can be removably attached to the main body of the apparatus. Recording media such as paper sheets are stacked in the recording medium cassette, and a feed roller is brought into contact, while rotating, with the uppermost one of the paper sheets to thereby feed that paper sheet into inside of the main body.

Some recording medium cassettes include an upper tray and a lower tray, the former being superposed on the latter, so that paper sheets of different sizes or types can be placed in the respective trays. Some recording medium cassettes further include an output tray located above the upper tray for receiving the paper sheet that has been printed and discharged.

For example, JP-A-2012-76871 discloses a sheet cassette that includes, as shown in FIG. 9A, a lower tray 81 and an upper tray 82 superposed thereon, and an output tray 83 located above the upper tray 82 for receiving the paper sheet that has been recorded and discharged. As shown in FIG. 9A, when the upper tray 82 is located on an upstream side in the direction in which the paper sheet is delivered (hereinafter, feed direction) X, i.e., on the left in FIG. 9A, a portion of the lower tray 81 on a downstream side in the feed direction X is exposed, and a paper sheet P11 placed on the lower tray 81 is contacted by a rotating feed roller (not shown) so as to be delivered in the feed direction X.

The sheet cassette 80 includes a lock mechanism that restricts the upper tray 82 from moving in the feed direction X, and the upper tray 82 includes a finger support 824 and an unlock lever 825 for unlocking the lock mechanism. The user unlocks the lock mechanism by holding with his/her fingers the finger support 824 and the unlock lever 825 exposed through a slot 830 formed in the output tray 83, and slides the upper tray 82 in the feed direction X with respect to the lower tray 81 to thereby displace the upper tray 82 to the downstream side in the feed direction X (on the right in FIGS. 9A and 9B), as shown in FIG. 9B. Then the rotating feed roller is brought into contact with the paper sheet P10 placed on the upper tray 82 to deliver the paper sheet P10 in the feed direction X.

The output tray 83 includes a pivotal shaft S10 rotatably disposed through a bearing hole 810 formed in a sidewall of the lower tray 81. The upper tray 82 includes a slide portion 820 configured to slide in the feed direction X supported by a guide portion (not shown), and a sheet placement unit 821 including a pivotal shaft S11 and pivotably connected to the slide portion 820. When the upper tray 82 is on the upstream side in the feed direction X as shown in FIG. 9A, the pivotal shaft S10 of the output tray 83 and the pivotal shaft S11 of the sheet placement unit 821 generally overlap each other.

When the intends to place the paper sheet P11 on the lower tray 81, the user pivots the output tray 83 and the sheet placement unit 821 together in a pivoting direction D10 with the upper tray 82 set on the upstream side in the feed direction X as shown in FIG. 9A, so as to expose the sheet placement surface 813 of the lower tray 81, as shown in FIG. 10A. Then the user inserts the paper sheet P11 in the feed direction X along the sheet placement surface 813, and sets the paper sheet P11 in position on the sheet placement surface 813 as shown in FIG. 10B, utilizing a pair of edge guides 811 and an edge guide 812 as reference.

In contrast, when the user intends to place the paper sheet P10 on the upper tray 82, the upper tray 82 is displaced to the downstream side in the feed direction X, as shown in FIG. 9B. The user slides the paper sheet P10 in the direction opposite to the feed direction X along the sheet placement surface 821*a* on the slide portion 821, and sets the paper sheet P10 in place on the sheet placement surface 821*a*, utilizing as reference a pair of edge guides 822 and an edge guide 823 exposed through a slot 831 formed in the output tray 83.

However, when the paper sheet P11 is to be placed on the lower tray 81 in the state shown in FIG. 10A, the upper tray 82 and the output tray 83 are located above the sheet placement surface 813 of the lower tray 81, at a generally central position in the feed direction X. In other words, in a view from above the sheet placement surface 813, the sheet placement surface 813 is split by the upper tray 82 and the output tray 83 into an upstream sheet placement surface 813*a* and a downstream sheet placement surface 813*b* in the feed direction X. Accordingly, the user has to insert the downstream edge of the paper sheet P11 in the feed direction X through a gap A1 between the slide portion 820 and the sheet placement surface 813 from the side of the upstream sheet placement surface 813*a* toward the downstream sheet placement surface 813*b*, so as to forward the paper sheet P11 in the feed direction X along the sheet placement surface 813. In addition, when the paper sheet P10 is to be placed on the upper tray 82 in the state shown in FIG. 9B, the output tray 83 overlaps the upstream portion of the sheet placement surface 821*a* in the feed direction X. Accordingly, the user has to insert the upstream edge of the paper sheet P10 in the feed direction X into a gap A2 between the output tray 83 and the sheet placement surface 821*a*, from the downstream side toward the upstream side in the feed direction X, to place the paper sheet P10 in position on the sheet placement surface 821*a*.

Thus, the configuration according to JP-A-2012-76871 impedes the user from efficiently placing the paper sheet P10 or P11 on the upper tray 82 or lower tray 81 of the sheet cassette 80. In other words, the user suffers difficulty in placing a paper sheet on an upper tray or lower tray of a sheet cassette having an output tray on top thereof.

SUMMARY

Accordingly, the invention may be advantageously realized as the following application examples and embodiments.

Application Example 1

A recording apparatus may include a recording unit, a lower sheet placement unit having a first sheet placement surface on which a first recording medium to be fed to the recording unit is placed, an upper sheet placement unit (i) having a second sheet placement surface on which a second recording medium to be fed to the recording unit is placed, and (ii) configured to slide above the lower sheet placement unit with respect thereto, a recorded medium receiver having a third sheet placement surface on which the first recording medium and the second recording medium that have undergone a recording operation of the recording unit are placed, the third sheet placement surface being located above the second sheet placement surface, a joint portion provided at one of end portions of the lower sheet placement unit in a feed direction and pivotably connecting the recorded medium receiver to the lower sheet placement unit, and a pivotal member (i) provided at the other end portion of the lower sheet placement unit in the feed direction and (ii) configured to allow the upper sheet placement unit to pivot with respect to the lower sheet placement unit.

With the recording apparatus thus configured, the recorded medium receiver is pivotably connected to the one end portion of the lower sheet placement unit in the feed direction. Accordingly, when the recorded medium receiver having the third sheet placement surface horizontally oriented is made to pivot so as to displace the third sheet placement surface away from the first sheet placement surface of the lower sheet placement unit, the entirety of the upper sheet placement unit is exposed. Such a configuration significantly facilitates the user to place the second recording medium on the second sheet placement surface of the upper sheet placement unit. In addition, when the upper sheet placement unit having the second sheet placement surface horizontally oriented is made to pivot so as to displace the second sheet placement surface away from the first sheet placement surface of the lower sheet placement unit, a major part of the first sheet placement surface is exposed. Therefore, the user is significantly facilitated to place the first recording medium on the lower sheet placement unit.

Application Example 2

The upper sheet placement unit may be shorter than the lower sheet placement unit in the feed direction.

Such a configuration suppresses an increase in size of the recording medium cassette that includes a plurality of sheet placement units.

Application Example 3

The upper sheet placement unit may be configured to allow the first recording medium placed on the first sheet placement surface of the lower sheet placement unit to be delivered, when the upper sheet placement unit is located at the one end portion in the feed direction.

With the mentioned configuration, the first sheet placement surface can be exposed by setting the upper sheet placement unit at the other end portion in the feed direction and making the upper sheet placement unit pivot.

Application Example 4

The upper sheet placement unit may be configured to allow the second recording medium placed on the second sheet placement surface of the upper sheet placement unit to be delivered, when the upper sheet placement unit is located at the other end portion in the feed direction.

With the mentioned configuration, the second sheet placement surface can be exposed by setting the upper sheet placement unit at the one end portion in the feed direction and making the recorded medium receiver pivot.

Application Example 5

A recording medium cassette that can be removably attached to a recording apparatus may include a lower sheet placement unit having a first sheet placement surface on which a first recording medium to be fed to a recording unit of the recording apparatus is placed, an upper sheet placement unit (i) having a second sheet placement surface on which a second recording medium to be fed to the recording unit of the recording apparatus is placed, and (ii) configured to slide above the lower sheet placement unit with respect thereto, a recorded medium receiver having a third sheet placement surface on which the first recording medium and the second recording medium that have undergone a recording operation of the recording unit are placed, the third sheet placement surface being located above the second sheet placement surface, a joint portion provided at one of end portions of the lower sheet placement unit in a feed direction and pivotably connecting the recorded medium receiver to the lower sheet placement unit, and a pivotal member (i) provided at the other end portion of the lower sheet placement unit in the feed direction and (ii) configured to allow the upper sheet placement unit to pivot with respect to the lower sheet placement unit.

With the recording medium cassette thus configured, the recorded medium receiver is pivotably connected to the one end portion of the lower sheet placement unit in the feed direction. Accordingly, when the recorded medium receiver having the third sheet placement surface horizontally oriented is made to pivot so as to displace the third sheet placement surface away from the first sheet placement surface of the lower sheet placement unit, the entirety of the upper sheet placement unit is exposed. Such a configuration significantly facilitates the user to place the second recording medium on the second sheet placement surface of the upper sheet placement unit. In addition, when the upper sheet placement unit having the second sheet placement surface horizontally oriented is made to pivot so as to displace the second sheet placement surface away from the first sheet placement surface of the lower sheet placement unit, a major part of the first sheet placement surface is exposed. Therefore, the user is significantly facilitated to place the first recording medium on the lower sheet placement unit.

Application Example 6

The recording medium cassette on which the recording medium is placed may be removably attached to the recording apparatus that performs a recording operation on the recording medium fed thereto and discharges the recording medium that has undergone the recording operation. The recording medium cassette may include a lower sheet placement unit having a first sheet placement surface on which a first recording medium is placed, an upper sheet placement unit having a second sheet placement surface on which a second recording medium is placed, and configured to slide with respect to the lower sheet placement unit, a recorded medium receiver having a third sheet placement surface on which the first recording medium and the second recording medium that have been discharged are placed, the third sheet placement surface being located above the second sheet placement surface, and a joint portion provided at one of end portions of the lower sheet placement unit in a feed direction and pivotably connecting the recorded medium receiver to the lower sheet placement unit.

With the recording medium cassette thus configured, the recorded medium receiver is pivotably connected to the one end portion of the lower sheet placement unit in the feed direction. Accordingly, when the recorded medium receiver having the third sheet placement surface horizontally oriented is made to pivot so as to displace the third sheet placement surface away from the first sheet placement surface of the lower sheet placement unit, the entirety of the upper sheet placement unit is exposed. Such a configuration significantly facilitates the user to place the second recording medium on the second sheet placement surface of the upper sheet placement unit.

Application Example 7

The upper sheet placement unit may include a pivotal member configured to pivot about a pivotal shaft, and the pivotal shaft may be movable to the end portion of the first sheet placement surface opposite to the joint portion in the feed direction.

With the mentioned configuration, when the recorded medium receiver having the third sheet placement surface horizontally oriented is made to pivot so as to displace the third sheet placement surface away from the first sheet placement surface of the lower sheet placement unit, and further the upper sheet placement unit having the second sheet placement surface horizontally oriented is made to pivot so as to displace the second sheet placement surface away from the first sheet placement surface of the lower sheet placement unit, a major part of the first sheet placement surface is exposed. Therefore, the user is significantly facilitated to place the first recording medium on the lower sheet placement unit.

Application Example 8

The upper sheet placement unit may be configured to pivot about a pivotal shaft, and the pivotal shaft may be movable to the end portion of the first sheet placement surface on the side of the joint portion in the feed direction.

With the mentioned configuration, when the recorded medium receiver having the third sheet placement surface horizontally oriented is made to pivot so as to displace the third sheet placement surface away from the first sheet placement surface of the lower sheet placement unit, and further the upper sheet placement unit having the second sheet placement surface horizontally oriented is made to pivot so as to displace the second sheet placement surface away from the first sheet placement surface of the lower sheet placement unit, a major part of the first sheet placement surface is exposed. Therefore, the user is significantly facilitated to place the first recording medium on the lower sheet placement unit.

Application Example 9

The recording apparatus may include a feeding unit that delivers the first recording medium and the second recording medium placed on the recording medium cassette, and a recording unit that performs a recording operation on the recording medium delivered from the feeding unit.

With the recording apparatus thus configured, the recorded medium receiver is pivotably connected to the one end portion of the lower sheet placement unit in the feed direction. Accordingly, when the recorded medium receiver having the third sheet placement surface horizontally oriented is made to pivot so as to displace the third sheet placement surface away from the first sheet placement surface of the lower sheet placement unit, the entirety of the upper sheet placement unit is exposed. Such a configuration significantly facilitates the user to place the second recording medium on the second sheet placement surface of the upper sheet placement unit. In addition, when the upper sheet placement unit having the second sheet placement surface horizontally oriented is made to pivot so as to displace the second sheet placement surface away from the first sheet placement surface of the lower sheet placement unit, a major part of the first sheet placement surface is exposed. Therefore, the user is significantly facilitated to place the first recording medium on the lower sheet placement unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1A:
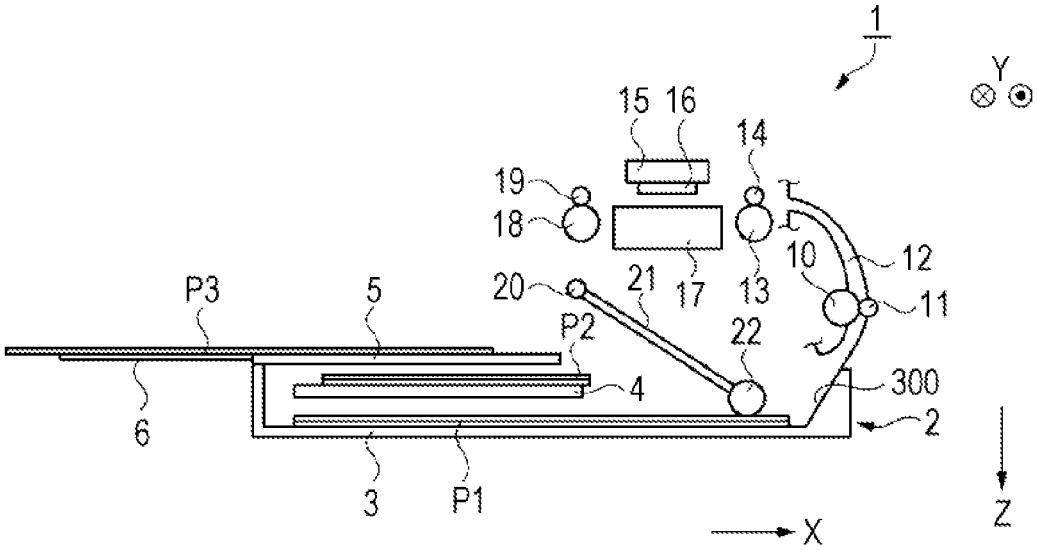
FIGS. 1A and 1B are schematic side views showing a general configuration of a printer according to an embodiment 1 of the invention.
Figure 1B:
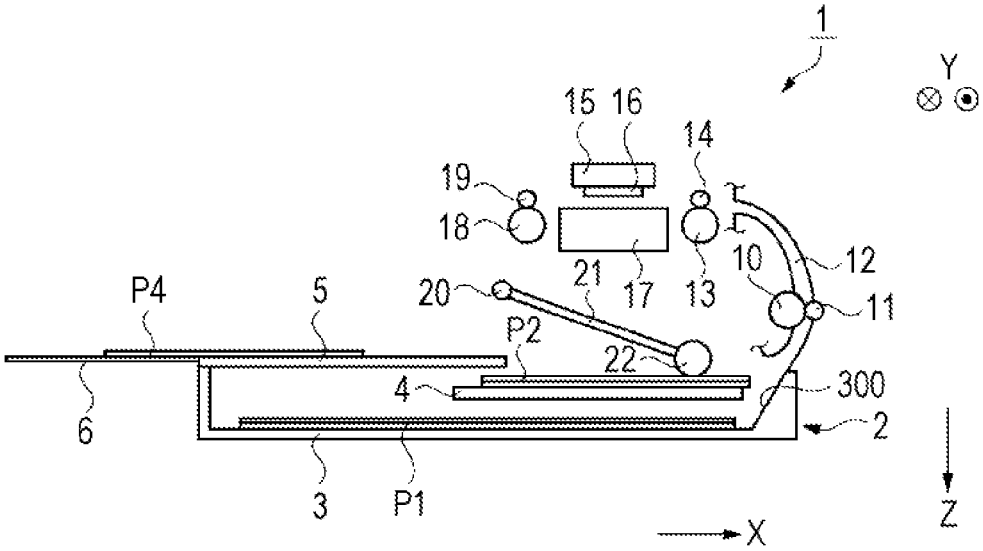

Hereafter, embodiments of the invention will be described referring to the drawings. FIGS. 1A and 1B are schematic side views showing a general configuration of a printer 1, exemplifying the recording apparatus according to the invention. A sheet cassette 2 exemplifying the recording medium cassette is removably attached to the main body of the printer 1. The sheet cassette 2 includes a lower tray 3 exemplifying the lower sheet placement unit and an upper tray 4 exemplifying the upper sheet placement unit. A paper sheet P1 corresponding to the first recording medium is to be placed on the former, and a paper sheet P2 corresponding to the second recording medium is to be placed on the latter.

The paper sheet P2 has a size of a postcard or the like, and the paper sheet P1 has a size larger than the paper sheet P2, such as A4 or B5. Naturally, the size of the paper sheet is not limited to the above, provided that the paper sheet placed on the upper tray is smaller than the paper sheet placed on the lower tray.

The upper tray 4 is configured to slide with respect to the lower tray 3 in a feed direction X. FIG. 1A illustrates a state in which the upper tray 4 overlaps the upstream region of the lower tray 3 in the feed direction X. FIG. 1B illustrates a state in which the upper tray 4 overlaps the downstream region of the lower tray 3 in the feed direction X.

A feed roller 22 is attached to an arm 21 that swings about a pivotal shaft 20. When the upper tray 4 is set to overlap the upstream region of the lower tray 3 in the feed direction X as shown in FIG. 1A, the feed roller 22 contacts, while rotating, the uppermost one of the paper sheets P1 stacked on the lower tray 3, to deliver the paper sheet P1 in the feed direction X. When the upper tray 4 is set to overlap the downstream region of the lower tray 3 in the feed direction X as shown in FIG. 1B, the feed roller 22 contacts, while rotating, the uppermost one of the paper sheets P2 stacked on the upper tray 4, to deliver the paper sheet P2 in the feed direction X. Thus, either of the paper sheet P1 or the paper sheet P2 can be selectively delivered according to the position of the upper tray 4 in the feed direction X.

A sloped surface 300 is provided in the lower tray 3, to split a plurality of paper sheets P1 or P2 about to be duplicatedly delivered. The paper sheet P1 or P2 that has passed the sloped surface 300 is transported along a transport route 12 by a pair of rollers composed of a transport drive roller 10 and a transport slave roller 11, and another pair of rollers composed of a transport drive roller 13 and a transport slave roller 14, to a position between a recording head 16 that ejects ink and a medium support member 17. Here, the mechanism that prevents duplicated delivery of the paper sheet may be provided in the main body of the printer 1.

A carriage 15 is set to reciprocate in a width direction Y (depth direction of FIGS. 1A and 1B) by a moving mechanism (not shown) along a guide shaft (not shown) disposed to extend in the width direction Y of the paper sheet P1, P2. The recording head 16 is mounted on the carriage 15 so as to eject the ink onto the paper sheet P1, P2.

The medium support member 17 is disposed opposite the recording head 16, to serve to support the paper sheet P1, P2 with a predetermined clearance between the paper sheet P1, P2 and the recording head 16.

A pair of rollers composed of a discharge drive roller 18 and a discharge slave roller 19 serve to discharge the paper sheet P1, P2 that has undergone the recording operation of the recording head 16, to an output tray 5 exemplifying the recorded medium receiver. A stacker 6 receives discharged paper sheet P3, P4 in collaboration with the output tray 5. Here, it is not mandatory to provide the stacker 6.

In this embodiment, the pivotal shaft 20, the arm 21, and the feed roller 22 constitute a feeding unit, the carriage 15, the recording head 16, and the medium support member 17 constitute the recording unit, and the pair of rollers composed of the discharge drive roller 18 and the discharge slave roller 19 constitute the discharging unit. Although the recording unit according to this embodiment includes an ink jet recording head 16 that ejects ink, the recording unit may be otherwise configured. For example, a laser printer that applies a toner to the paper sheet P1, P2 and performs the recording by thermal pressing may be employed.

Figure 2A:
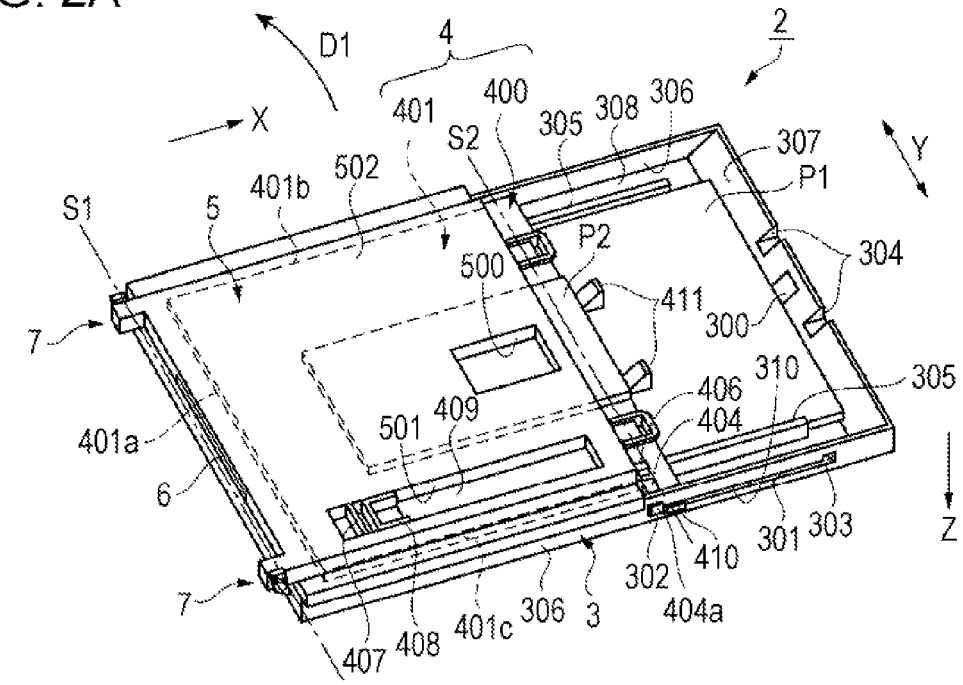
FIGS. 2A and 2B are perspective views showing a sheet cassette according to the embodiment 1.
Figure 2B:
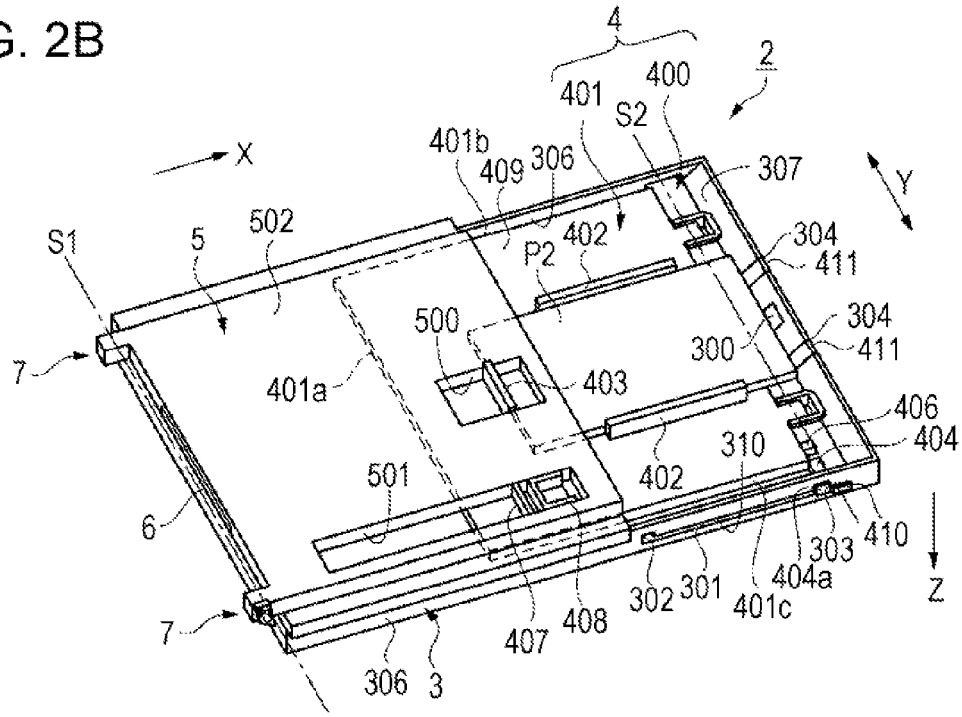

FIGS. 2A and 2B are perspective views showing the sheet cassette 2. FIG. 2A illustrates the state in which the upper tray 4 overlaps the upstream region of the lower tray 3 in the feed direction X (see FIG. 1A), and FIG. 2B illustrates the state in which the upper tray 4 overlaps the downstream region of the lower tray 3 in the feed direction X (see FIG. 1B).

The paper sheet P1 is placed on a first sheet placement surface 308 of the lower tray 3 as shown in FIG. 2A. The respective end portions of the paper sheet P1 in the width direction Y are delimited by a pair of edge guides 305, and the upstream end portion of the paper sheet P1 in the feed direction X is delimited by an edge guide 309 (see FIG. 5B).

A wall 307 formed on the downstream end portion of the lower tray 3 in the feed direction X includes a pair of slits 304 as shown in FIG. 2A. When the upper tray 4 is on the downstream side in the feed direction X as shown in FIG. 2B, a pair of projections 411 formed on the downstream end portion of the upper tray 4 in the feed direction X are respectively inserted in the pair of slits 304, thus to be engaged therewith.

As described above, the wall 307 on the downstream end portion of the lower tray 3 in the feed direction X includes the sloped surface 300 provided between the pair of slits 304, for splitting the paper sheets P1 or P2 about to be delivered in duplicate by the feed roller 22 shown in FIGS. 1A and 1B.

The upper tray 4 including a slide portion 400 and a sheet placement base 401 is located above the first sheet placement surface 308 in a vertical direction Z (hereinafter, simply "above"). The upper tray 4 is located below the output tray 5 in the vertical direction Z (hereinafter, simply "below"). The upstream end portion 401*a* of the sheet placement base 401 in the feed direction X, and the respective end portions 401*b*, 401*c* in the width direction Y are indicated by broken lines.

The sheet placement base 401 includes a pivotal shaft S2, via which the sheet placement base 401 is pivotably connected to the slide portion 400. Walls 306 on the respective sides of the lower tray 3 in the width direction Y each include a guide rail 301 constituted of a slot 310 extending in the feed direction X.

The slide portion 400 includes projections 410 formed to protrude outwardly from the respective sides of the slide portion 400 in the width direction Y. The projections 410 are each disposed to penetrate through the slot 310 and to slide in the feed direction X along the guide rail 301.

With the mentioned configuration, the sheet placement base 401 can move in the feed direction X, with the paper sheet P2 horizontally placed thereon.

As shown in FIG. 2B, the paper sheet P2 is placed on a second sheet placement surface 409 of the upper tray 4. The end portions of the paper sheet P2 in the width direction Y are delimited by the pair of edge guides 402, and the upstream end portion of the paper sheet P2 in the feed direction X is delimited by an edge guide 403 exposed in a slot 500 formed in the output tray 5.

The upper tray 4 includes an engagement mechanism for locking the upper tray 4 at the most upstream position shown in FIG. 2A as well as at the most downstream position shown in FIG. 2B. The engagement mechanism includes a finger support 407 and an operating lever 408 to be manipulated for locking and unlocking the upper tray 4.

To be more detailed, the finger support 407 and the operating lever 408 provided on the upper tray 4 are exposed through a slot 501 formed in the output tray 5. The finger support 407 is fixed to the sheet placement base 401. The operating lever 408 is disposed so as to slide with respect to the sheet placement base 401. When the user holds the finger support 407 and the operating lever 408 with his/her fingers, a pivot element 406 is made to swing so as to allow the slider 404 to move in the width direction Y.

Figure 3:
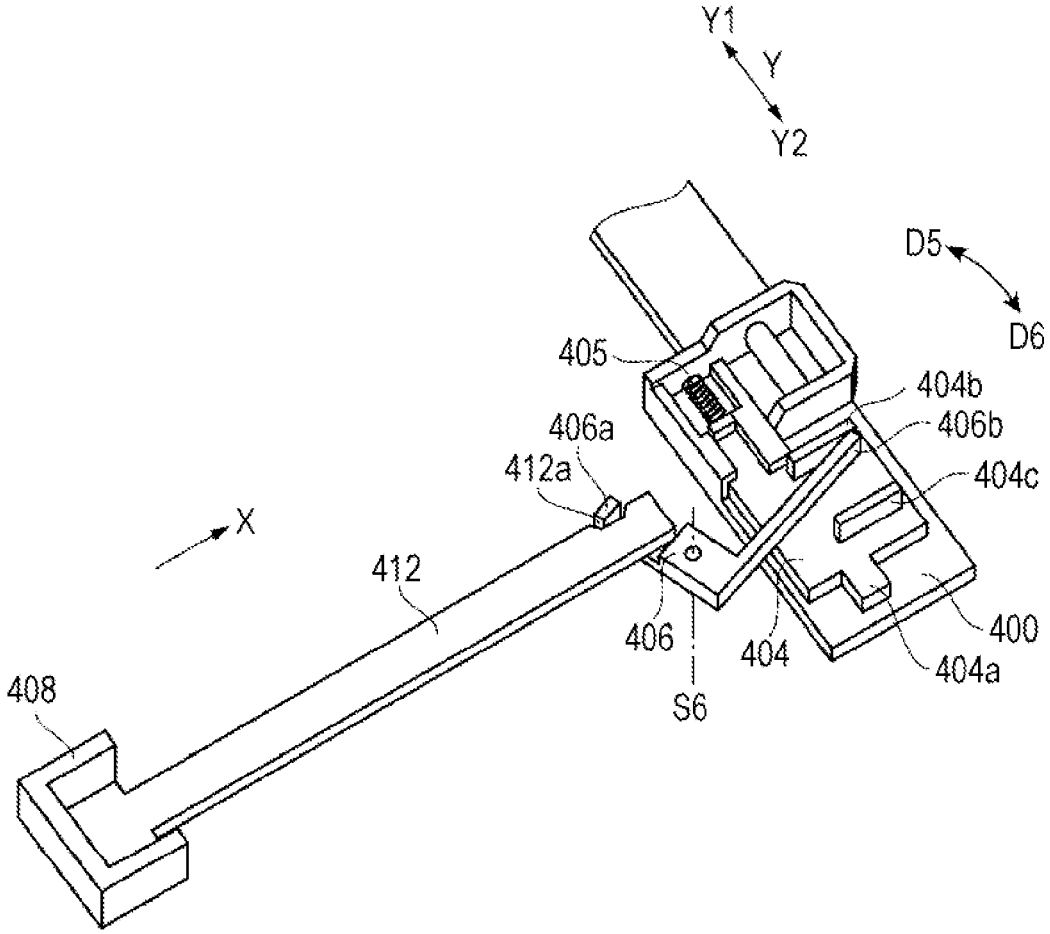
FIG. 3 is a perspective view for explaining a mechanism that causes a pivot element to swing with an unlock lever, to thereby allow a slider to move.

FIG. 3 is a perspective view for explaining the mechanism that causes the pivot element 406 to swing by manipulating the operating lever 408, to thereby allow the slider 404 to move. FIG. 3 illustrates the state in which the user is holding the finger support 407 and the operating lever 408 with the fingers.

The pivot element 406 is disposed to pivot about a pivotal shaft S6, so that an end portion 406*b* of the pivot element 406 moves within a range delimited by projections 404*b*, 404*c* formed on the slider 404. The other end portion 406*a* of the pivot element 406 is engaged with a slit 412*a* of a joint bar 412 extending from the operating lever 408.

When the user holds the finger support 407 and the operating lever 408 shown in FIGS. 2A and 2B with the fingers, the operating lever 408 is made to slide to the downstream side in the feed direction X. Then the pivot element 406 is made to pivot counterclockwise D5 about the pivotal shaft S6 by means of the joint bar 412, so that the end portion 406*b* of the pivot element 406 presses the projection 404*b* of the slider 404 inwardly Y1 in the width direction Y.

Accordingly, the slider 404 is inwardly displaced (Y1) and hence the end portion 404*a* of the slider 404 is disengaged from an orifice 302 or 303 formed in the wall 306 of the lower tray 3 as shown in FIGS. 2A and 2B, and the upper tray 4 is enabled to move in the feed direction X.

The slider 404 is outwardly biased in the width direction Y (Y2) by a spring 405. Therefore, when the finger support 407 and the operating lever 408 are released by the user, the slider 404 is outwardly displaced (Y2) so that the end portion 404*a* of the slider 404 is inserted in the orifice 302 or 303 to restrict the upper tray 4 from moving in the feed direction X.

In addition, the end portion 406*b* of the pivot element 406 is outwardly displaced (Y2) by the projection 404*b*, and therefore the pivot element 406 is made to pivot clockwise (D6) so that the operating lever 408 is made to slide in the feed direction X by means of the joint bar 412.

The paper sheet P3, P4 discharged through the discharge drive roller 18 and the discharge slave roller 19 shown in FIGS. 1A and 1B is placed on a third sheet placement surface 502 of the output tray 5.

The stacker 6 having a plate shape is slidably accommodated inside the upstream portion of the output tray 5 in the feed direction X, so that when the stacker 6 is drawn out from the output tray 5 the upstream portion of the discharged paper sheet P3, P4 in the feed direction can be supported by the stacker 6.

Figure 4A:
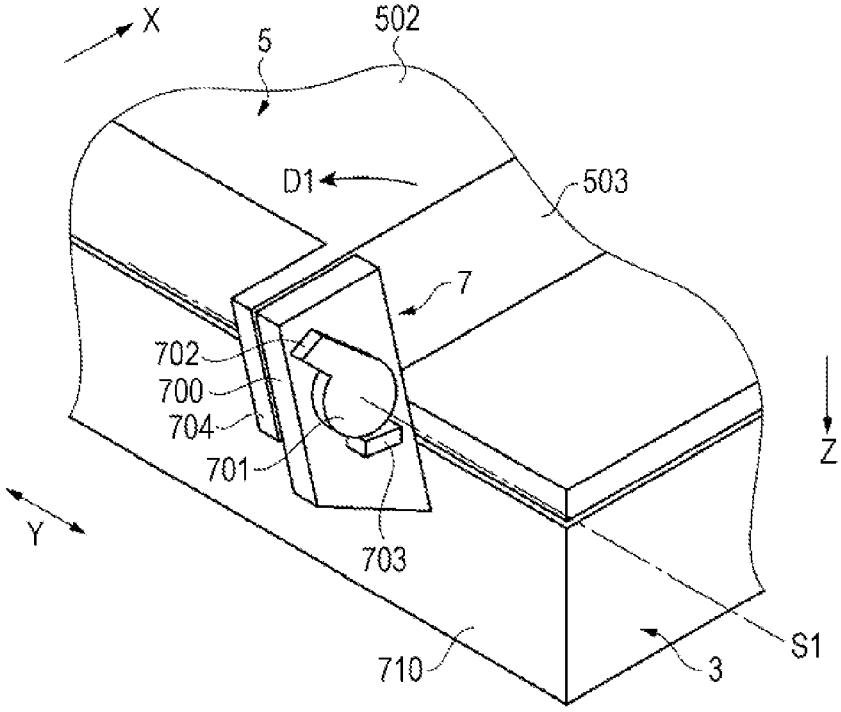
FIGS. 4A and 4B are enlarged fragmentary perspective views showing a joint portion.
Figure 4B:
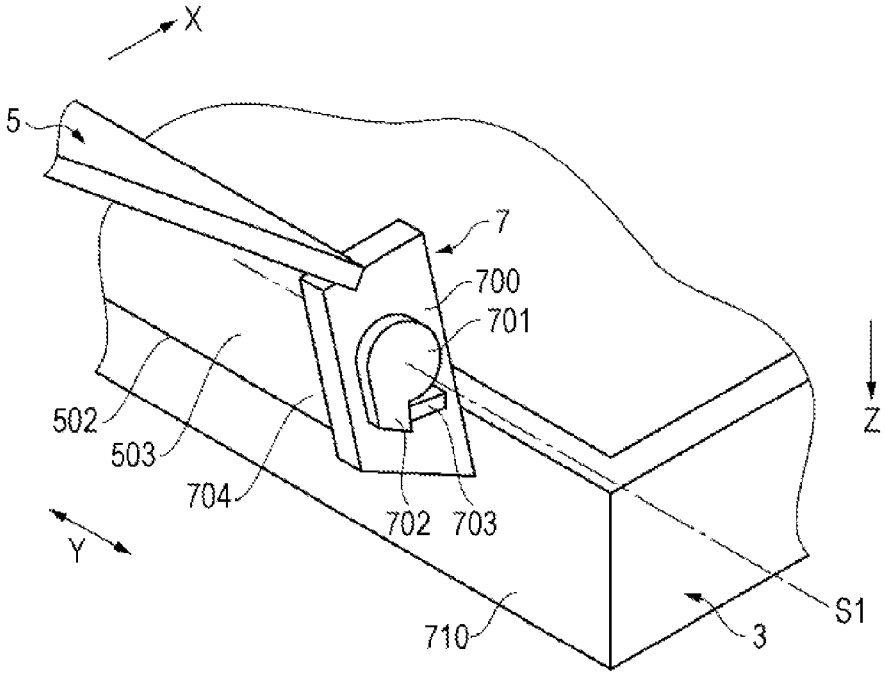

A pair of joint portions 7 are provided at the upstream end portion of the sheet cassette 2 in the feed direction X. The joint portions 7 include a pivotal shaft S1 and serve to pivotably connect the output tray 5 to the lower tray 3. FIGS. 4A and 4B are enlarged perspective views showing the joint portion 7.

FIG. 4A illustrates a state in which the output tray 5 shown in FIGS. 2A and 2B overlaps a part of the lower tray 3, i.e., the third sheet placement surface 502 is horizontally oriented. The joint portion 7 essentially includes a fixing base 700, a pivotal member 701, and a projection 704. The output tray 5 includes the projection 704 projecting to the upstream side in the feed direction X from a stepped portion 503 downwardly formed on the third sheet placement surface 502. The fixing base 700 is provided on a wall 710 on the upstream side of the lower tray 3 in the feed direction X. The projection 704 is disposed to pivot about the pivotal shaft S1 with respect to the fixing base 700.

The pivotal member 701 is fixed to the projection 704, so as to rotate interlocked with the pivotal motion of the projection 704. The pivotal member 701 includes a projection 702 outwardly projecting from a circumferential edge of the pivotal member 701. The fixing base 700 includes a stopper 703 outwardly projecting in the width direction Y.

FIG. 4B illustrates a state in which the output tray 5 shown in FIG. 2A is made to pivot in a pivoting direction D1 so that the lower tray 3 is exposed. The projection 702 of the pivotal member 701 shown in FIG. 4B is made to abut the stopper 703, so that the output tray 5 is restricted from pivoting further.

Figure 5A:
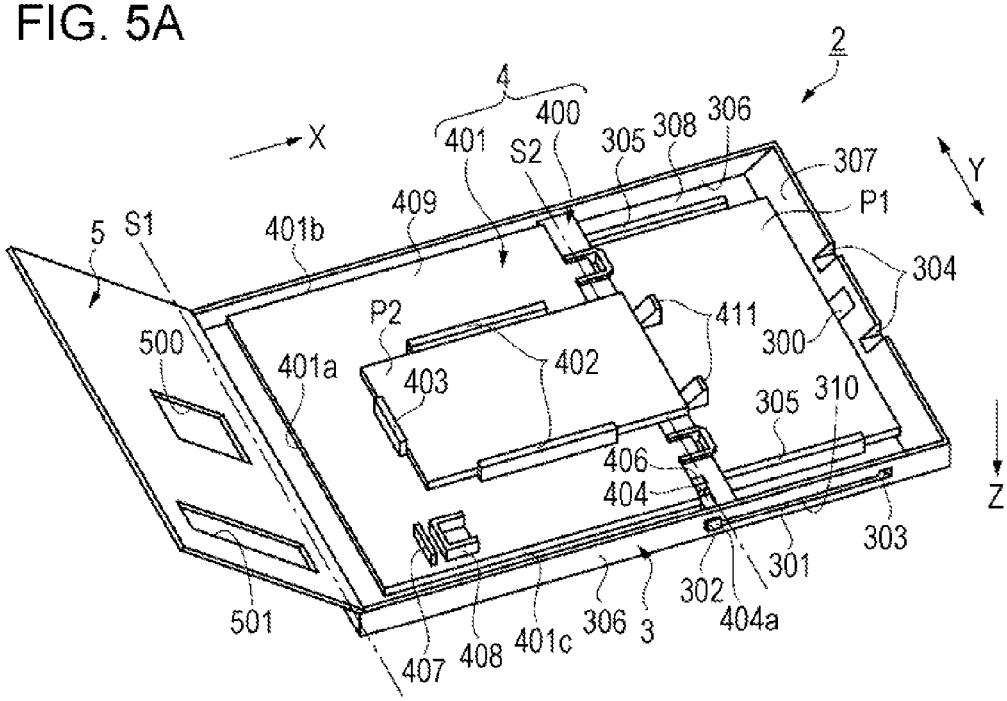
FIGS. 5A and 5B are perspective views showing the sheet cassette in different operational stages.

FIG. 5A is a perspective view of the sheet cassette 2 set for placing the paper sheet P2 on the upper tray 4. When the output tray 5 set in the state shown in FIG. 2A is made to pivot about the pivotal shaft S1 in the pivoting direction D1 (pivoting direction in which the output tray 5 is displaced away from the first sheet placement surface 308), the upper tray 4 is exposed as shown in FIG. 5A. Thus, in the state shown in FIG. 5A, the output tray 5 is not located above the second sheet placement surface 409. Such a configuration significantly facilitates the user to place the paper sheet P2 on the second sheet placement surface 409.

Figure 5B:
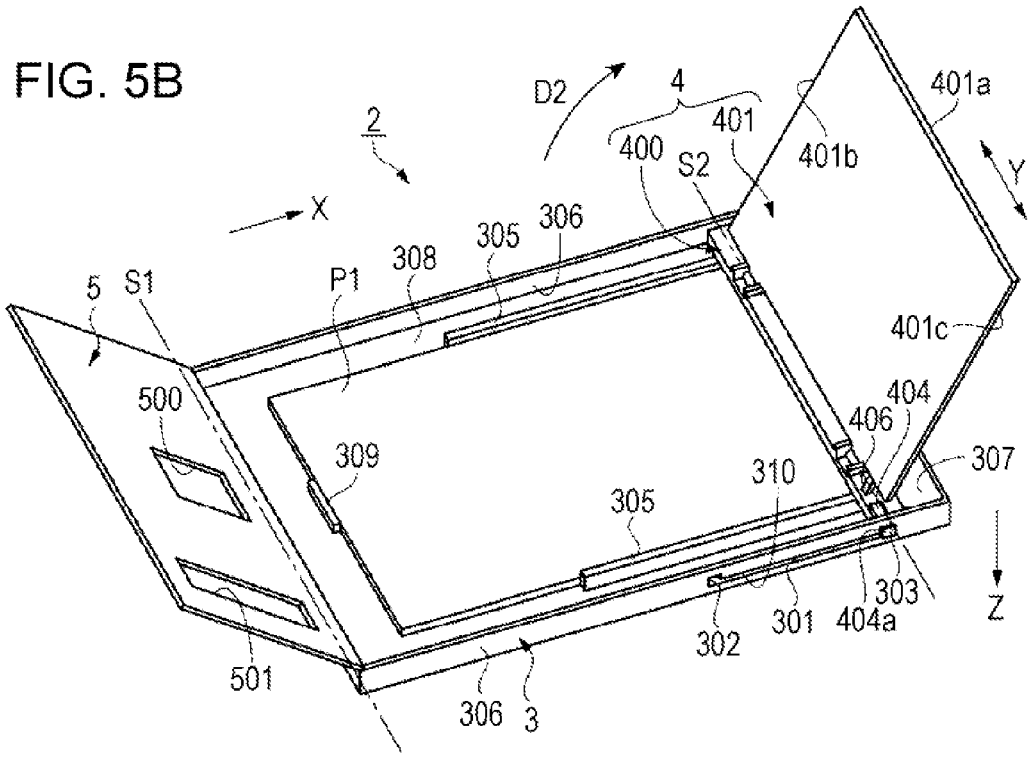

FIG. 5B is a perspective view of the sheet cassette 2 set for placing the paper sheet P1 on the lower tray 3. The upper tray 4 in the state shown in FIG. 5A is made to slide to the downstream side in the feed direction X, so that the pivotal shaft S2 is located at the downstream end portion of the first sheet placement surface 308 in the feed direction X. Then upon making the sheet placement base 401 pivot about the pivotal shaft S2 in the pivoting direction D2 (pivoting direction in which the sheet placement base 401 is displaced away from the first sheet placement surface 308), the state shown in FIG. 5B can be achieved.

In the state shown in FIG. 5B, a major part of the first sheet placement surface 308 of the lower tray 3 is exposed. In addition, the first sheet placement surface 308 is exempted from being split in the feed direction X when viewed from above, because of the output tray 5 and the upper tray 4 being located above the first sheet placement surface 308 at a generally central position in the feed direction X. Such a configuration significantly facilitates the user to place the paper sheet P1 on the first sheet placement surface 308.

Thus, the sheet cassette 2 according to this embodiment is for use with the printer 1 that includes the feeding unit that delivers the paper sheet P1, P2, the recording unit that performs the recording operation on the paper sheet P1, P2 delivered from the feeding unit, and the discharging unit that discharges the paper sheet P1, P2 that has undergone the recording operation of the recording unit. The sheet cassette 2 includes the lower tray 3 having first sheet placement surface 308 on which the paper sheet P1 is placed, the upper tray 4 (i) having the second sheet placement surface 409 on which the paper sheet P2 is placed and pivotably disposed above the first sheet placement surface 308, and (ii) configured to slide with respect to the lower tray 3, the output tray 5 having the third sheet placement surface 502 located above the second sheet placement surface 409 and on which the paper sheet P1, P2 (P3, P4) discharged from the discharging unit is to be placed, and the joint portion 7 provided at one of end portions of the lower tray 3 in the feed direction X and pivotably connecting the output tray 5 to the lower tray 3.

Hereunder, description will be given on the process of placing the paper sheet P2 on the second sheet placement surface 409 of the upper tray 4 from the state shown in FIG. 2A in which the third sheet placement surface 502 of the output tray 5 is horizontally oriented and the upper tray 4 is located on the upstream side.

When the output tray 5 is made to pivot about the pivotal shaft S1 such that the third sheet placement surface 502 horizontally oriented as shown in FIG. 2A is displaced away from the first sheet placement surface 308 of the lower tray 3 (pivoting direction D1), the entirety of the upper tray 4 is exposed as shown in FIG. 5A. Such an arrangement significantly facilitates the user to place the paper sheet P2 on the second sheet placement surface 409 of the upper tray 4.

The process of placing the paper sheet P1 on the first sheet placement surface 308 of the lower tray 3 will now be described hereunder. The upper tray 4 is disposed so as to pivot about the pivotal shaft S2, and pivotal shaft S2 is movable to the end portion of the first sheet placement surface 308 opposite to the joint portion 7 in the feed direction X. When the upper tray 4 is located on the upstream side as shown in FIG. 2A, the upper tray 4 is disengaged from the lower tray 3 by manipulation of the finger support 407 and the operating lever 408. Then the slide portion 400 of the upper tray 4 is moved along the guide rail 301 of the lower tray 3 to the downstream position shown in FIG. 2B, so that the upper tray 4 is again engaged with the lower tray 3.

Then the output tray 5 disposed such that the third sheet placement surface 502 is horizontally oriented as shown in FIG. 2B is made to pivot about the pivotal shaft S1 so as to displace the third sheet placement surface 502 away from the first sheet placement surface 308 of the lower tray 3 (pivoting direction D1). Further, when the upper tray 4 disposed such that the second sheet placement surface 409 is horizontally oriented is made to pivot about the pivotal shaft S2 so as to displace the second sheet placement surface 409 away from the first sheet placement surface 308 of the lower tray 3 (pivoting direction D2), a major part of the first sheet placement surface 308 is exposed as shown in FIG. 5B. Such an arrangement significantly facilitates the user to place the paper sheet P1 on the lower tray 3.

In this embodiment, the joint portion 7 is located at the upstream end portion of the lower tray 3 in the feed direction X. Such a configuration allows the sheet cassette 2 to be attached to the printer 1 such that the joint portion 7 sticks out from the main body to the upstream side in the feed direction X, thereby suppressing an increase in size of the main body of the printer 1 due to increased length of the main body in the feed direction X.

Although in this embodiment the fixing base 700 is provided on the wall 710 on the upstream side of the lower tray 3 in the feed direction X, a bearing hole may be provided in the upstream end portion of the wall 306 of the lower tray 3 in the feed direction X, so as to form a joint portion that pivotably connects the output tray 5 to the lower tray 3.

Variations

In the embodiment 1, the joint portion 7 connecting the lower tray 3 and the output tray 5 is provided at the upstream end portion of the lower tray 3 in the feed direction X. Alternatively, the joint portion may be provided at the downstream end portion of the lower tray.

Figure 6A:
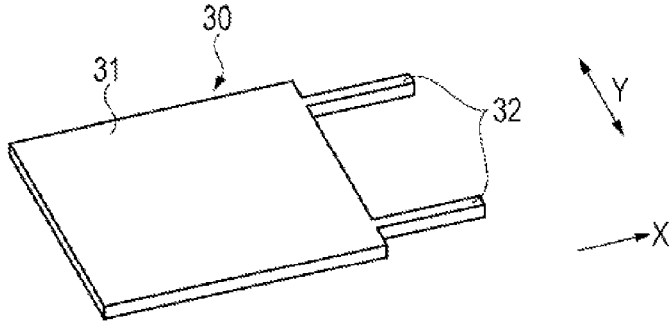
FIG. 6A is a perspective view showing an output tray according to a variation.

FIG. 6A is a perspective view showing an output tray 30 according to a variation, exemplifying the recorded medium receiver. The output tray 30 includes a third sheet placement surface 31, and a pair of support members 32 sticking out from the respective end portions of the third sheet placement surface 31 in the width direction Y to the downstream side in the feed direction X.

Figure 6B:
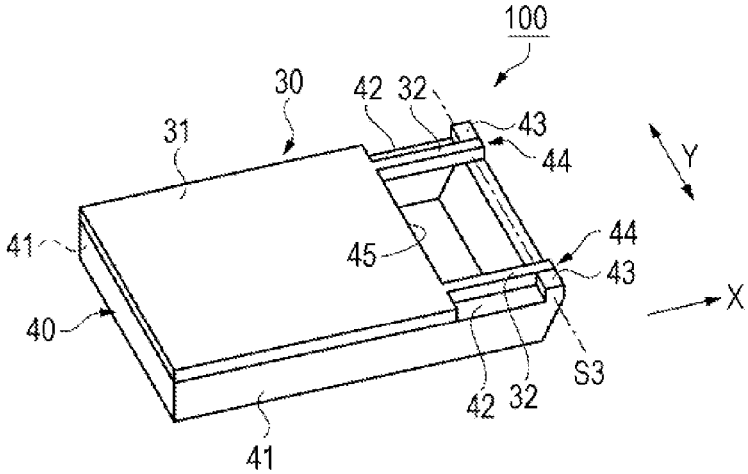
FIG. 6B is a perspective view showing a sheet cassette according to the variation.

FIG. 6B is a perspective view showing a sheet cassette 100 including the output tray 30 provided on a lower tray 40 according to the variation, exemplifying the lower sheet placement unit, in which the upper tray is not shown. A slot 45 is provided on the downstream side of the output tray 30 in the feed direction X downstream.

The lower tray 40 includes a pair of projections 43 upwardly protruding in the vertical direction Z from an upper end face 42 of walls 41 on the respective sides in the width direction Y. A pair of joint portions 44 each including the end portion of the support member 32 and the projection 43 are provided at the respective downstream end portions of the lower tray 40 in the feed direction X. The joint portions 44 include a pivotal shaft S3 for pivotably connecting the output tray 30 to the lower tray 40.

Figure 6C:
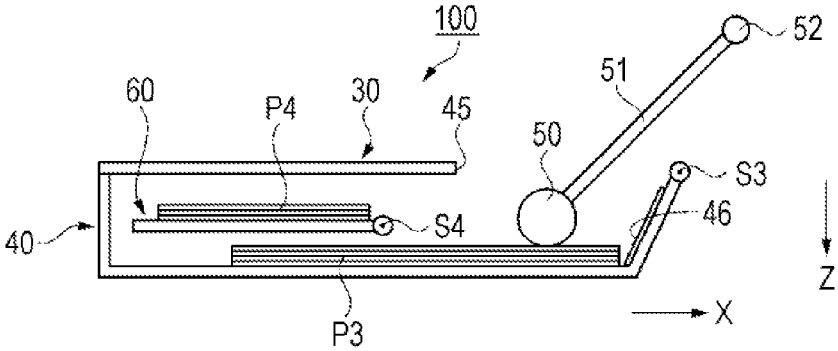
FIGS. 6C and 6D are schematic side views of the sheet cassette according to the variation.
Figure 6D:
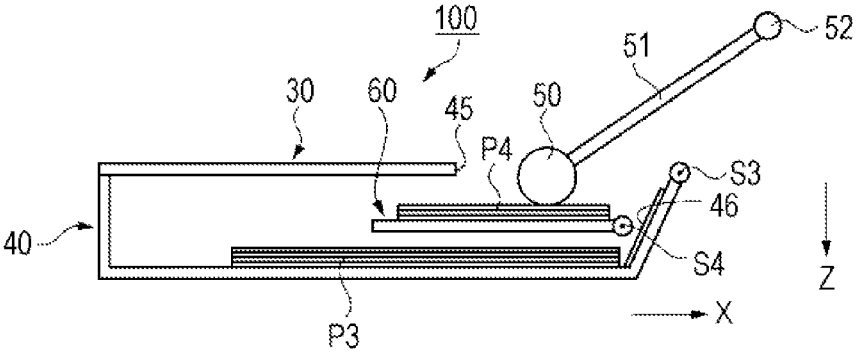

FIGS. 6C and 6D are schematic side views of the sheet cassette 100 seen in the width direction Y. FIG. 6C illustrates a state in which the paper sheet P3 exemplifying the first recording medium placed on the lower tray 40 is being delivered. An upper tray 60 is located on the upstream side in the feed direction X, and hence the downstream portion of the paper sheet P3 in the feed direction X is exposed through the slot 45.

A feed roller 50 is attached to an arm 51 pivotably supported by a pivotal shaft 52, and brought into contact with the uppermost paper sheet P3 while rotating. Accordingly, the paper sheet P3 is delivered in the feed direction X and fed to a recording unit along a sloped surface 46.

FIG. 6D illustrates a state in which the paper sheet P4 exemplifying the second recording medium placed on the upper tray 60 is being delivered. The upper tray 60 is located on the downstream side in the feed direction X, and hence the downstream portion of the paper sheet P4 in the feed direction X is exposed through the slot 45. The feed roller 50 is brought into contact with the uppermost paper sheet P4 while rotating. Accordingly, the paper sheet P4 is delivered in the feed direction X and fed to the recording unit along the sloped surface 46.

As shown in FIG. 6C, the upper tray 60 includes a pivotal shaft S4 at the downstream end portion of the upper tray 60 in the feed direction X. When the upper tray 60 is made to slide to the downstream side in the feed direction X as shown in FIG. 6D, the pivotal shaft S4 of the upper tray 60 is moved to the downstream end portion of a first sheet placement surface 47 of the lower tray 40 in the feed direction X.

Figure 7A:
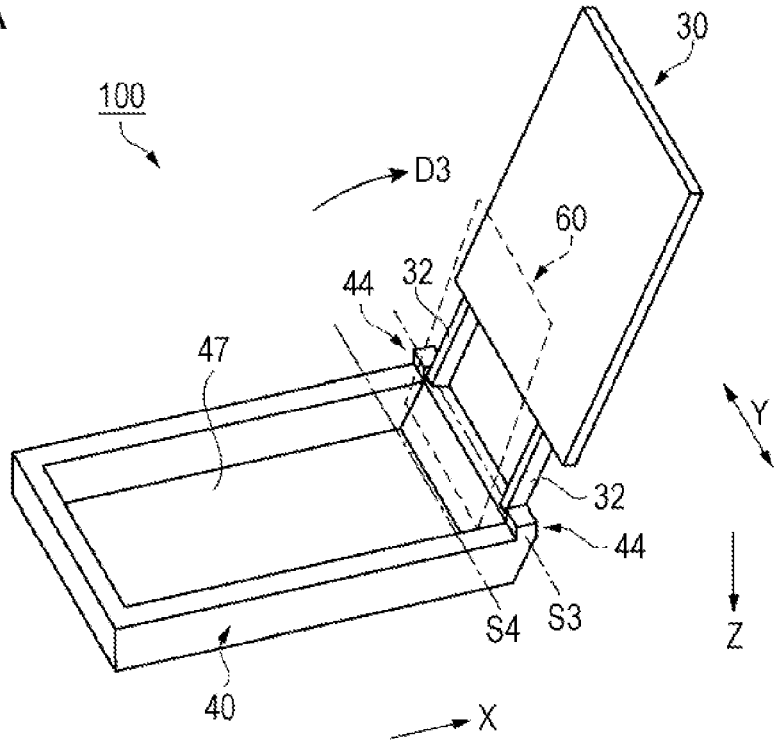
FIGS. 7A and 7B are perspective views showing the sheet cassette according to the variation.

FIG. 7A is a perspective view showing the sheet cassette 100 set for placing the paper sheet P3 on the first sheet placement surface 47 of the lower tray 40. The output tray 30 shown in FIG. 6A is made to pivot in a pivoting direction D3 as shown in FIG. 7A. Then the upper tray 60 shown in FIG. 6D is made to pivot about the pivotal shaft S4 in the pivoting direction D3, to the position indicated by broken lines in FIG. 7A.

As a result, a major part of the first sheet placement surface 47 is exposed, and therefore the user is significantly facilitated to place the paper sheet P3 on the first sheet placement surface 47.

Figure 7B:
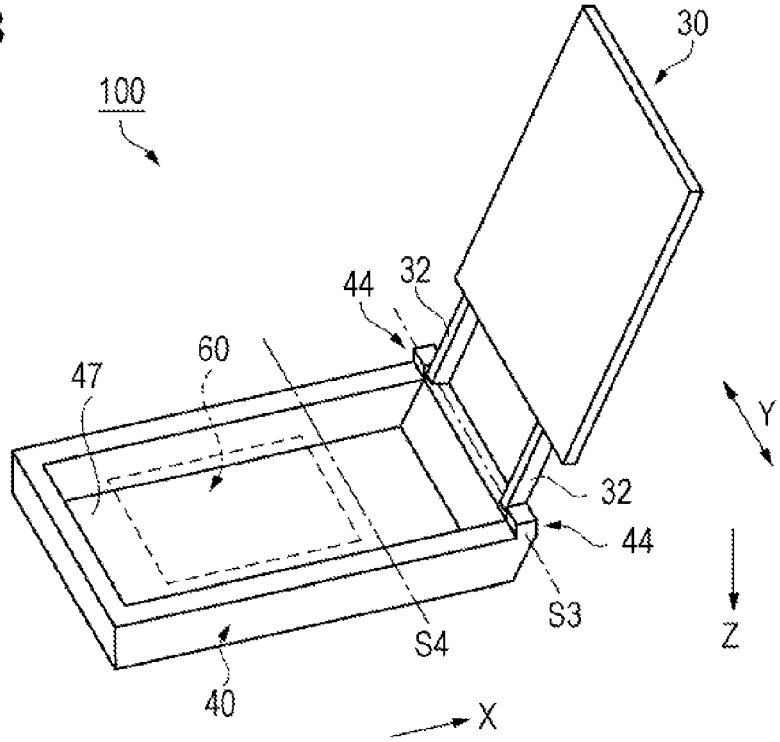

FIG. 7B is a perspective view showing the sheet cassette 100 set for placing the paper sheet P4 on the upper tray 60. The upper tray 60 disposed as indicated by broken lines is moved to the upstream side in the feed direction X with respect to the lower tray 40. Since the upper tray 60 is exposed in this process, the user is significantly facilitated to place the paper sheet P4 on the upper tray 60.

In the embodiment 1, the pivotal shaft S2 of the upper tray 4 is movable to the end portion of the first sheet placement surface 308 opposite to the joint portion 7 in the feed direction X. In this variation, alternatively, the pivotal shaft S4 of the upper tray 60 is movable to the end portion of the first sheet placement surface 47 in the feed direction X, on the side of the joint portion 44.

In this variation, the joint portions 44 are provided at the downstream end portion of the lower tray 40 in the feed direction X. Accordingly, the user can visually recognize the upper tray 60 and the lower tray 40 exposed on the front side, upon making the output tray 30 pivot with the sheet cassette 100 drawn out to the upstream side in the feed direction X from the main body of the printer. Thus, the user can place the paper sheet P3, P4 on the upper tray 60 or lower tray 40, without changing the orientation of the sheet cassette 100.

Embodiment 2

The pivotal shaft S2 of the upper tray 4 according to the embodiment 1 and the pivotal shaft S4 of the upper tray 60 according to the variation are movable to the downstream end portion of the first sheet placement surface 308 and the first sheet placement surface 47 in the feed direction X, respectively. Alternatively, the pivotal shaft S4 may be movable to the upstream end portion of the first sheet placement surface 47 in the feed direction X.

Figure 8:
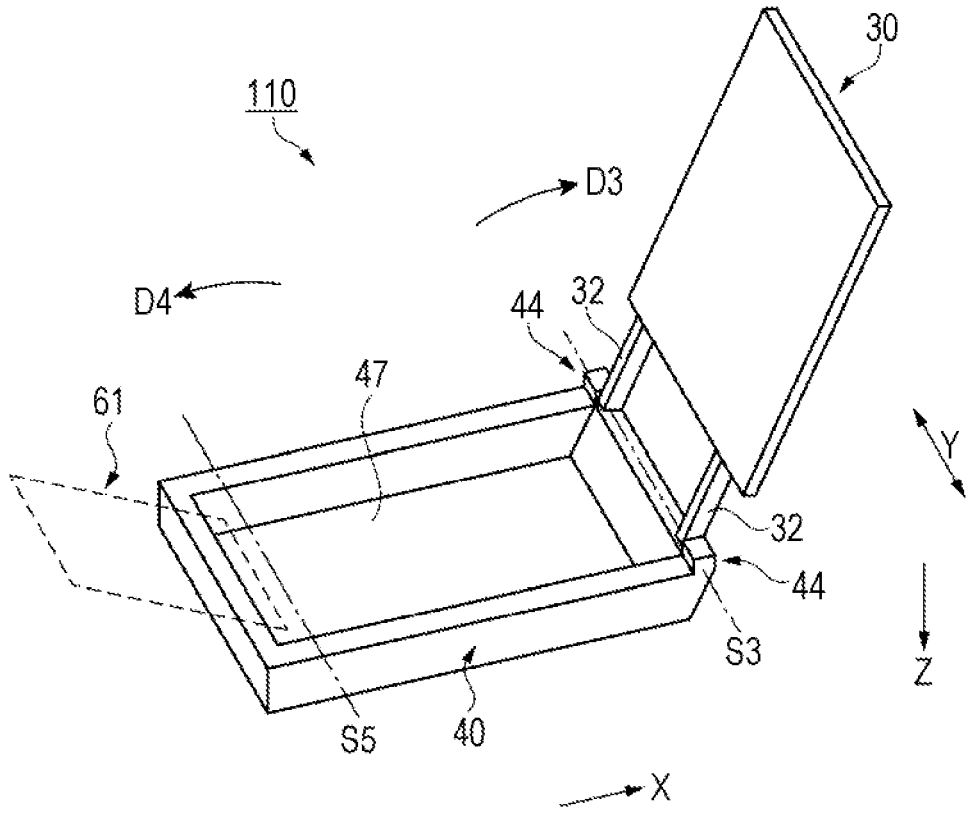
FIG. 8 is a perspective view showing the sheet cassette according to an embodiment 2.
Figure 9A:
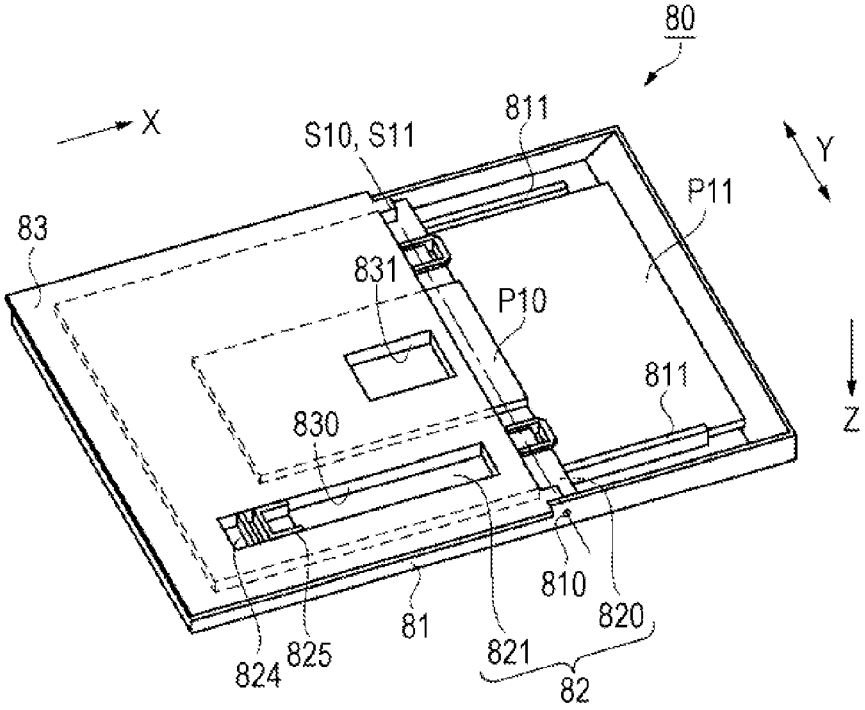
FIGS. 9A and 9B are perspective views showing a conventional sheet cassette.
Figure 9B:
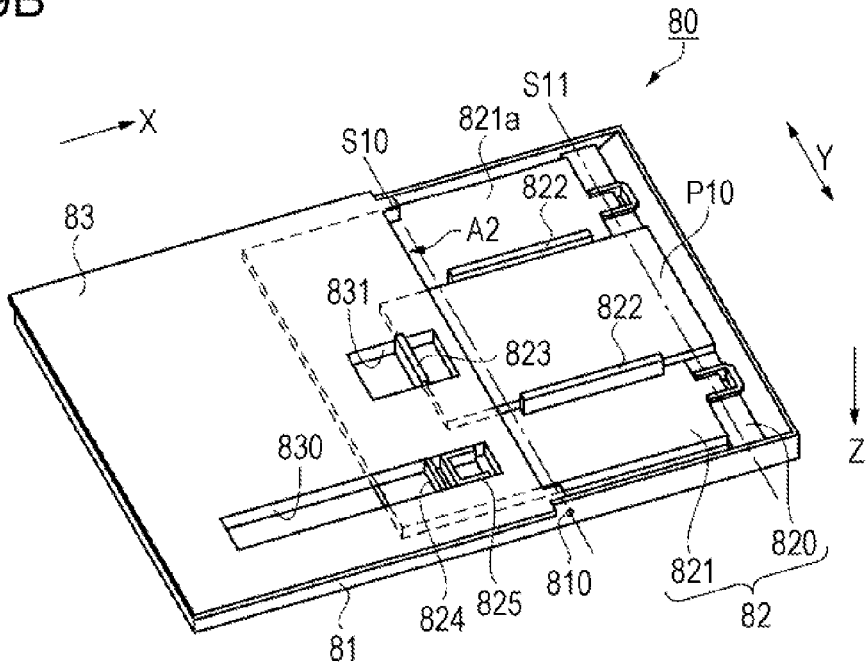
Figure 10A:
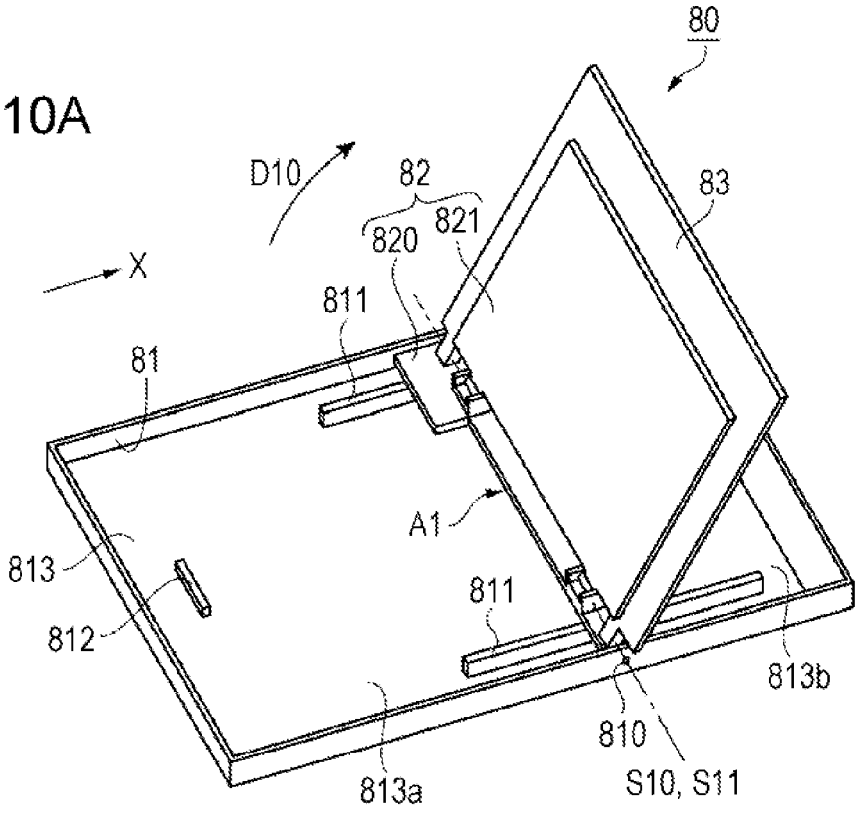
FIGS. 10A and 10B are perspective views showing the conventional sheet cassette in different operational stages.
Figure 10B:
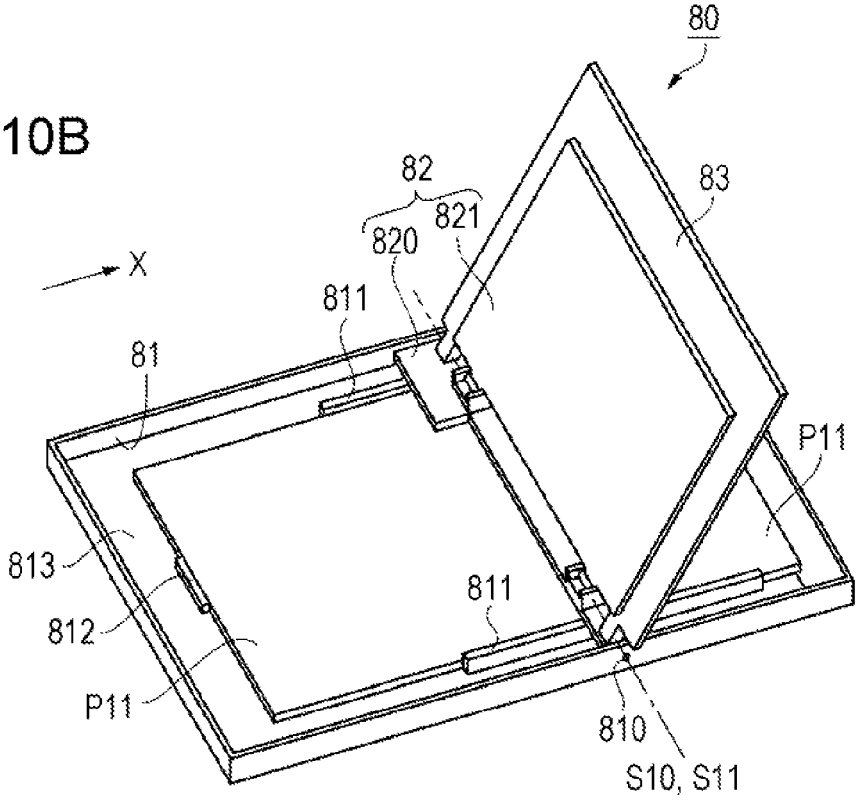

FIG. 8 is a perspective view showing a sheet cassette 110, exemplifying the recording medium cassette, according to an embodiment 2. The sheet cassette 110 includes the output tray 30 according to the variation pivotably disposed about the joint portions 44 provided at the downstream end portion of the lower tray 40 in the feed direction X.

A pivotal shaft S5 of an upper tray 61 indicated by a dash-dot line is disposed so as to slide to the upstream end portion of the first sheet placement surface 47 of the lower tray 40 in the feed direction X. When the output tray 30 is made to pivot in the pivoting direction D3 and the upper tray 61 is made to pivot in a pivoting direction D4 as shown in FIG. 8, a major part of the first sheet placement surface 47 of the lower tray 40 is exposed.

Such a configuration significantly facilitates the user to place the paper sheet on the first sheet placement surface 47. Further, when the upper tray 61 is horizontally oriented with the output tray 30 displaced in the pivoting direction D3, the entirety of the upper tray 61 is exposed. Therefore, the user is significantly facilitated to place the paper sheet on the upper tray 61.

The entire disclosure of Japanese Patent Application No. 2012-182988, filed Aug. 22, 2012 is expressly incorporated by reference herein.

What is claimed is:

1. A recording apparatus comprising:

a recording unit;

a lower sheet placement unit having a first sheet placement surface on which a first recording medium to be fed to the recording unit is placed;

an upper sheet placement unit (i) having a second sheet placement surface on which a second recording medium to be fed to the recording unit is placed, and (ii) configured to slide above the lower sheet placement unit with respect thereto;

a recorded medium receiver having a third sheet placement surface on which the first recording medium and the second recording medium that have undergone a recording operation of the recording unit are placed, the third sheet placement surface being located above the second sheet placement surface;

a joint portion provided at one of end portions of the lower sheet placement unit in a feed direction and pivotably connecting the recorded medium receiver to the lower sheet placement unit; and a pivotal member provided at the other end portion of the lower sheet placement unit in the feed direction, and configured to allow the upper sheet placement unit to pivot with respect to the lower sheet placement unit.

2. The recording apparatus according to claim 1, wherein the upper sheet placement unit is shorter than the lower sheet placement unit in the feed direction.

3. The recording apparatus according to claim 1, wherein the upper sheet placement unit is configured to allow the first recording medium placed on the first sheet placement surface of the lower sheet placement unit to be delivered, when the upper sheet placement unit is located at the one end portion in the feed direction.

4. The recording apparatus according to claim 3, wherein the upper sheet placement unit is configured to allow the second recording medium placed on the second sheet placement surface of the upper sheet placement unit to be delivered, when the upper sheet placement unit is located at the other end portion in the feed direction.

5. A recording medium cassette that can be removably attached to a recording apparatus, the recording medium cassette comprising:

a lower sheet placement unit having a first sheet placement surface on which a first recording medium to be fed to a recording unit of the recording apparatus is placed;

an upper sheet placement unit (i) having a second sheet placement surface on which a second recording medium to be fed to the recording unit of the recording apparatus is placed, and (ii) configured to slide above the lower sheet placement unit with respect thereto;

a recorded medium receiver having a third sheet placement surface on which the first recording medium and the second recording medium that have undergone a recording operation of the recording unit are placed, the third sheet placement surface being located above the second sheet placement surface;

a joint portion provided at one of end portions of the lower sheet placement unit in a feed direction and pivotably connecting the recorded medium receiver to the lower sheet placement unit; and a pivotal member provided at the other end portion of the lower sheet placement unit in the feed direction, and configured to allow the upper sheet placement unit to pivot with respect to the lower sheet placement unit.

* * * * *